US010633782B2

(12) United States Patent
Leibman

(10) Patent No.: US 10,633,782 B2
(45) Date of Patent: Apr. 28, 2020

(54) WASHING MACHINE APPLIANCE SPRAY HOSE ASSEMBLY

(71) Applicant: Haier US Appliance Solutions, Inc., Wilmington, DE (US)

(72) Inventor: Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 232 days.

(21) Appl. No.: 15/785,478

(22) Filed: Oct. 17, 2017

(65) Prior Publication Data

US 2019/0112749 A1 Apr. 18, 2019

(51) Int. Cl.

| | |
|---|---|
| ***D06F 39/08*** | (2006.01) |
| ***D06F 39/02*** | (2006.01) |
| ***D06F 39/14*** | (2006.01) |
| ***D06F 23/04*** | (2006.01) |
| ***D06F 39/12*** | (2006.01) |
| ***D06F 39/00*** | (2020.01) |
| *D06F 33/02* | (2006.01) |

(52) U.S. Cl.

CPC ..... *D06F 39/088* (2013.01); *D06F 39/005* (2013.01); *D06F 39/022* (2013.01); *D06F 39/087* (2013.01); *D06F 23/04* (2013.01); *D06F 33/02* (2013.01); *D06F 39/02* (2013.01); *D06F 39/12* (2013.01); *D06F 39/14* (2013.01); *D06F 2204/08* (2013.01); *D06F 2216/00* (2013.01)

(58) Field of Classification Search

CPC ..... D06F 39/02; D06F 39/022; D06F 39/088

See application file for complete search history.

(56) References Cited

U.S. PATENT DOCUMENTS

| | | | | |
|---|---|---|---|---|
| 8,459,067 | B2 | 6/2013 | Kendall et al. | |
| 2016/0090681 | A1* | 3/2016 | Nash | D06F 39/028 68/17 R |
| 2016/0102425 | A1 | 4/2016 | Scheckelhoff | |
| 2016/0138207 | A1 | 5/2016 | Del Pos et al. | |

* cited by examiner

*Primary Examiner* — Spencer E Bell

(74) *Attorney, Agent, or Firm* — Dority & Manning, P.A.

(57) ABSTRACT

A washing machine appliance includes a cabinet with a wash tub mounted within the cabinet and a wash basket rotatably mounted within the wash tub. An opening is defined in the cabinet above a gap between the wash tub and the wash basket. An additive dispenser extends between the opening and the gap. The washing machine appliance also includes a spray hose assembly fluidly connected to a wash fluid source and a dock configured to retain the spray head in a docked position with the opening whereby the spray hose assembly is in fluid communication with the additive dispenser.

17 Claims, 9 Drawing Sheets

WASHING MACHINE APPLIANCE SPRAY HOSE ASSEMBLY

FIELD OF THE INVENTION

The present subject matter relates generally to washing machine appliances, and more particularly to accessories for washing machine appliances.

BACKGROUND OF THE INVENTION

Washing machine appliances generally form a wash fluid to clean clothing articles disposed within a wash basket of the appliance. The wash fluid can include water and various fluid additives, e.g., detergent, fabric softener, and/or bleach. The fluid additives can be mixed with water within a wash tub of the appliance in order to form the wash fluid.

During operation of certain washing machine appliances, a volume of wash fluid is directed into the tub in order to wash and/or rinse articles within the wash chamber. More specifically, a predetermined volume of wash fluid is typically provided through a stationary nozzle positioned at the center of the back wall of the washing machine appliance. However, in certain situations, a user may wish to have additional wash fluid dispensed into the tub and/or may wish to direct the flow of wash fluid onto a particular garment or within a specific region of the wash tub, e.g., to perform a pretreating operation, to saturate a particular article of clothing, or to accommodate an extra-large load. The ability to adjust the amount of water or wash fluid and its dispensing location is a commercially desirable feature and increases the user's positive perception of the wash process generally.

To introduce fluid additive into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a tray or container mounted to a top panel of a vertical axis washing machine appliance can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance. However, through continuous use, the dispenser cup may build up an undesirable amount of residue from one or more of the fluid additives. The user may be required to remove the dispenser cup, transport the dispenser cup to, e.g., a kitchen sink, and manually wash the dispenser cup in order to remove the undesired residue.

Accordingly, a washing machine appliance that provides a user with more control over the dispensing of wash fluid is desirable. For example, a washing machine appliance including one or more features to allow dispensing of an additional amount of wash fluid at a desired location, such as the dispenser cup, would be useful.

BRIEF DESCRIPTION OF THE INVENTION

The present invention provides a washing machine with a spray hose assembly for selectively providing a flow of wash fluid in a desired direction and location. The washing machine also includes a dock configured to retain the spray hose assembly in a docked position with an opening whereby the spray hose assembly is in fluid communication with an additive dispenser. Additional aspects and advantages of the invention will be set forth in part in the following description, or may be apparent from the description, or may be learned through practice of the invention.

In one exemplary embodiment, a washing machine appliance is provided. The washing machine appliance includes a cabinet that defines a vertical direction. A wash tub is mounted within the cabinet and configured for containing fluid during operation of the washing machine appliance. A wash basket is rotatably mounted within the wash tub. The wash tub and the wash basket define a gap between the wash tub and the wash basket. A top panel of the cabinet includes an opening positioned above the gap between the wash tub and the wash basket along the vertical direction. The washing machine appliance also includes an additive dispenser extending between the opening of the top panel and the gap between the wash tub and the wash basket. The washing machine appliance also includes a spray hose assembly fluidly connected to a wash fluid source and configured for selectively providing a flow of wash fluid in a desired direction and location. The spray hose assembly includes a hose and a spray head attached to the hose. The washing machine appliance also includes a dock configured to retain the spray head in a docked position with the opening whereby the spray hose assembly is in fluid communication with the additive dispenser.

In another exemplary embodiment, a washing machine appliance is provided. The washing machine appliance includes a cabinet that defines a vertical direction. A wash tub is mounted within the cabinet and configured for containing fluid during operation of the washing machine appliance. A wash basket is rotatably mounted within the wash tub. The wash tub and the wash basket define a gap between the wash tub and the wash basket. A top panel of the cabinet includes an opening positioned above the gap between the wash tub and the wash basket along the vertical direction. The washing machine appliance also includes an additive dispenser extending between the opening of the top panel and the gap between the wash tub and the wash basket. The washing machine appliance also includes a spray hose assembly fluidly connected to a wash fluid source and configured for selectively providing a flow of wash fluid in a desired direction and location. The spray hose assembly includes a hose and a spray head attached to the hose. The washing machine appliance also includes a bezel extending around a perimeter of the opening. The bezel is configured to retain the spray head in a docked position with the additive dispenser whereby the spray hose assembly is in fluid communication with the additive dispenser In yet another exemplary embodiment, a washing machine appliance is provided. The washing machine appliance includes a cabinet that defines a vertical direction. A wash tub is mounted within the cabinet and configured for containing fluid during operation of the washing machine appliance. A wash basket is rotatably mounted within the wash tub. The wash tub and the wash basket define a gap between the wash tub and the wash basket. A top panel of the cabinet includes an opening positioned above the gap between the wash tub and the wash basket along the vertical direction. The washing machine appliance also includes an additive dispenser extending between the opening of the top panel and the gap between the wash tub and the wash basket. The washing machine appliance also includes a spray hose assembly fluidly connected to a wash fluid source and configured for selectively providing a flow of wash fluid in a desired direction and location. The spray hose assembly includes a hose and a spray head attached to the hose. The spray head includes a rib. The rib is configured to retain the spray head in a docked position with the opening whereby the spray hose assembly is in fluid communication with the additive dispenser.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
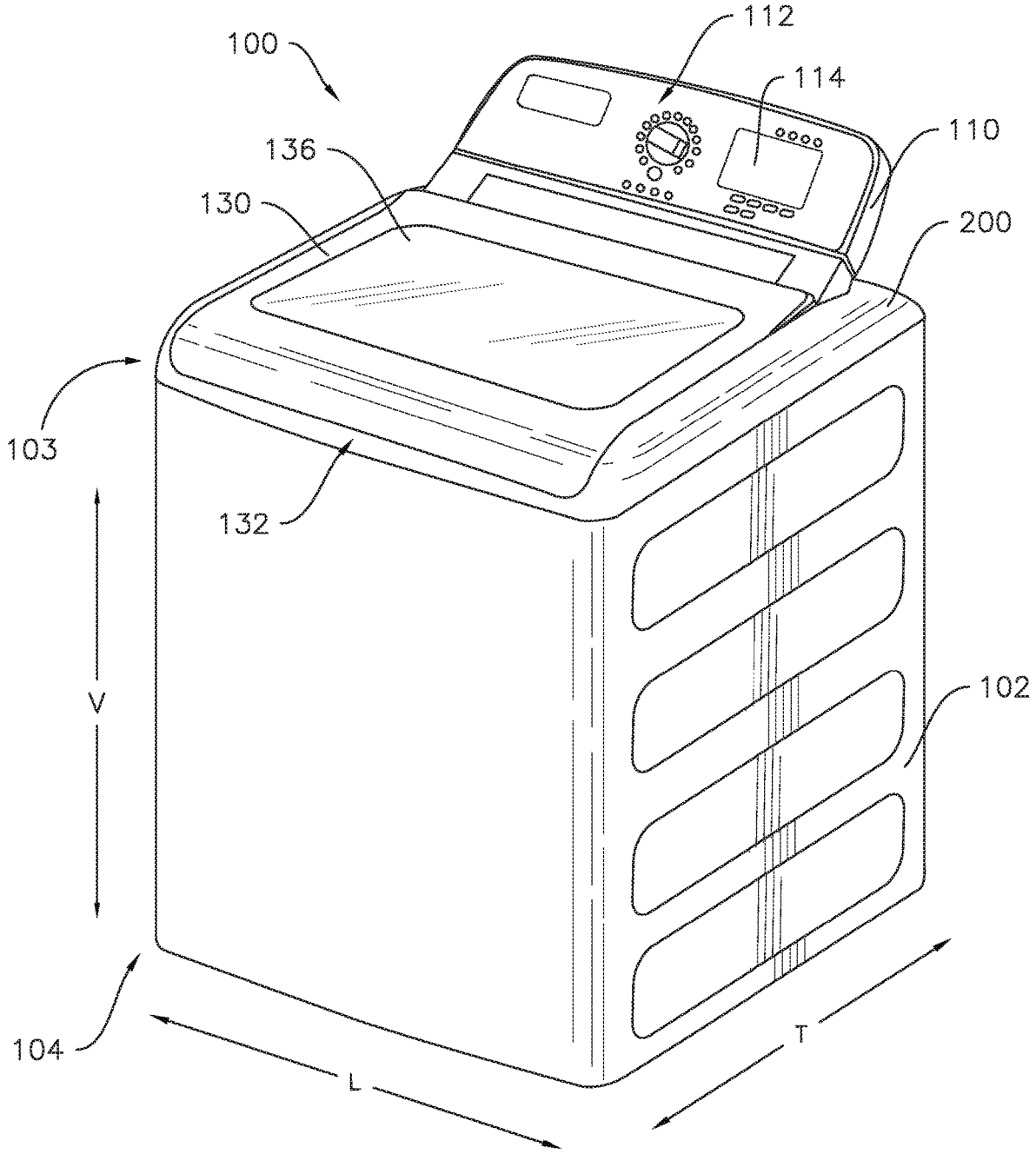
FIG. 1 provides a perspective view of an exemplary washing machine appliance that may incorporate various embodiments of the present subject matter with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
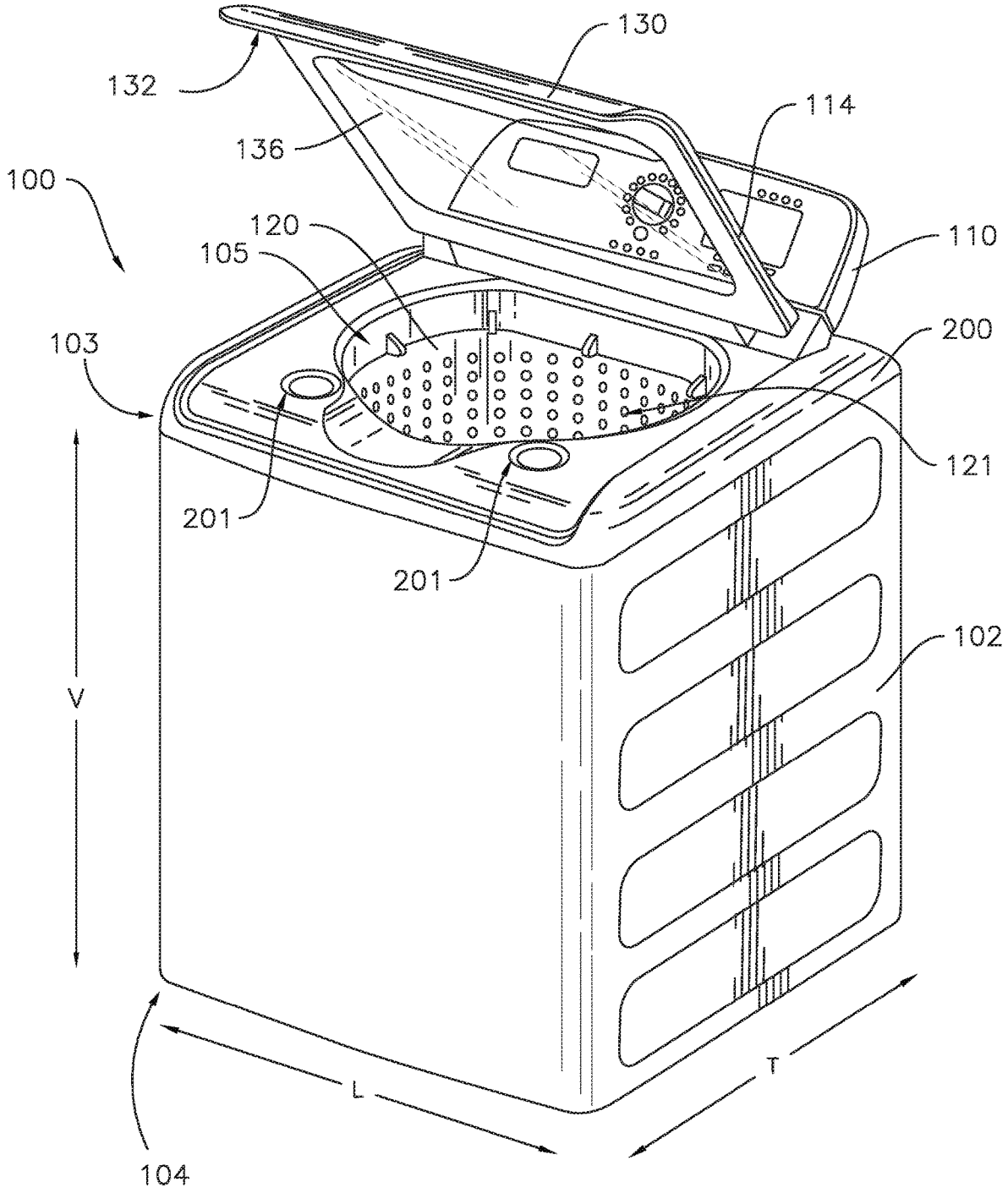
FIG. 2 provides a perspective view of the exemplary washing machine appliance of FIG. 1 with a door or lid of the washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that defines a lateral direction L, a transverse direction T, and a vertical direction V. The lateral direction L, transverse direction T, and vertical direction V are mutually perpendicular and define an orthogonal coordinate system. As shown, cabinet 102 extends between a top 103 and a bottom 104 along the vertical direction V. A wash basket 120 (FIG. 2) is rotatably mounted within cabinet 102. For example, a wash tub 124 (FIG. 3) may mounted within the cabinet 102, as described in more detail below, and the wash basket 120 may be rotatably mounted within the wash tub 124. A motor (not shown) is in mechanical communication with wash basket 120 in order to selectively rotate wash basket 120 (e.g., during an agitation or a rinse cycle of washing machine appliance 100). Wash basket 120 defines a wash chamber 121 (FIG. 2) that is configured for receipt of articles for washing. An agitator or impeller extends from wash basket 120 into wash chamber 121 to assist agitation of articles disposed within wash chamber 121 during operation of washing machine appliance 100.

Cabinet 102 of washing machine appliance 100 has a top panel 200. Top panel 200 defines an aperture 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Top panel 200 also defines at least one hole or opening 201 (FIG. 2). The opening 201 is configured for receipt of fluid additives, e.g., detergent, fabric softener, and/or bleach. As used herein, the terms "additive" or "fluid additive" generally refer to fluids other than water, such as detergent, bleach, fabric softener and/or other such laundry treatment chemicals. The opening 201 permits the fluid additive or additives to pass through top panel 200 to a fluid additive dispenser 210 (FIGS. 4 through 7) disposed on or below top panel 200 along the vertical direction V. Various exemplary embodiments of the opening(s) 201 and fluid additive dispenser 210 are described in greater detail below.

A control panel 110 with a plurality of input selectors 112 (FIG. 1) extends from top panel 200. Control panel 110 and input selectors 112 collectively form a user interface input for operator selection of machine cycles and features. A display 114 of control panel 130 indicates selected features, a countdown timer, and/or other items of interest to appliance users.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

Various sensors may additionally be included in the washing machine appliance 100. For example, a pressure sensor 90 may be positioned in the tub 124 as illustrated. Any suitable pressure sensor 90, such as an electronic sensor, a manometer, or another suitable gauge or sensor, may be utilized. The pressure sensor 90 may generally measure the pressure of water in the tub 124. This pressure can then be utilized to estimate the height or level of water in the tub 124. Additionally, a suitable speed sensor (not shown) can be provided to measure rotational speed of basket 120. Other suitable sensors, such as temperature sensors, etc., may additionally be provided in the washing machine appliance 100.

In an illustrative embodiment, laundry items may be loaded into wash chamber 121 through aperture 105, and washing operation may be initiated through operator manipulation of input selectors 112. Wash basket 120 (and/or wash tub 124 shown in FIG. 3) may be filled with water and detergent to form a wash fluid. One or more valves, e.g., valves 78 and 80, can be controlled by washing machine appliance 100 to provide for filling wash basket 120 to the appropriate level for the amount of articles being washed. Once wash basket 120 is properly filled with fluid, the contents of wash chamber 121 are agitated for cleansing of laundry items in wash basket 120.

After the agitation phase of the wash cycle is completed, wash basket 120 may be drained. Laundry articles can then be rinsed by again adding fluid to wash basket 120, depending on the particulars of the cleaning cycle selected by a user, impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through aperture 105.

Wash tub 124 is configured for containing fluid, e.g., wash and rinse fluids, during operation of washing machine appliance 100 described above. Wash and rinse fluids disposed within wash tub 124 can be used to clean articles disposed in wash basket 120. Wash and rinse fluids can pass between wash basket 120 and wash tub 124 through a plurality of apertures defined by wash basket 120, e.g., during the wash and/or spin cycles described above.

Various valves may regulate the flow of fluid into and through washing machine appliance 100 from water sources 76 and 77, e.g., water source 76 may include one or more fluid lines, pipes, conduits, etc. which provide hot water to washing machine appliance 100, e.g., from a residential water heater (not shown) and water source 77 may include one or more fluid lines, pipes, conduits, etc. which provide cold water to washing machine appliance 100. For example, a hot water valve 78 and a cold water valve 80 may be positioned in such fluid lines to flow hot water and cold water, respectively, to washing machine appliance 100.

Figure 3:
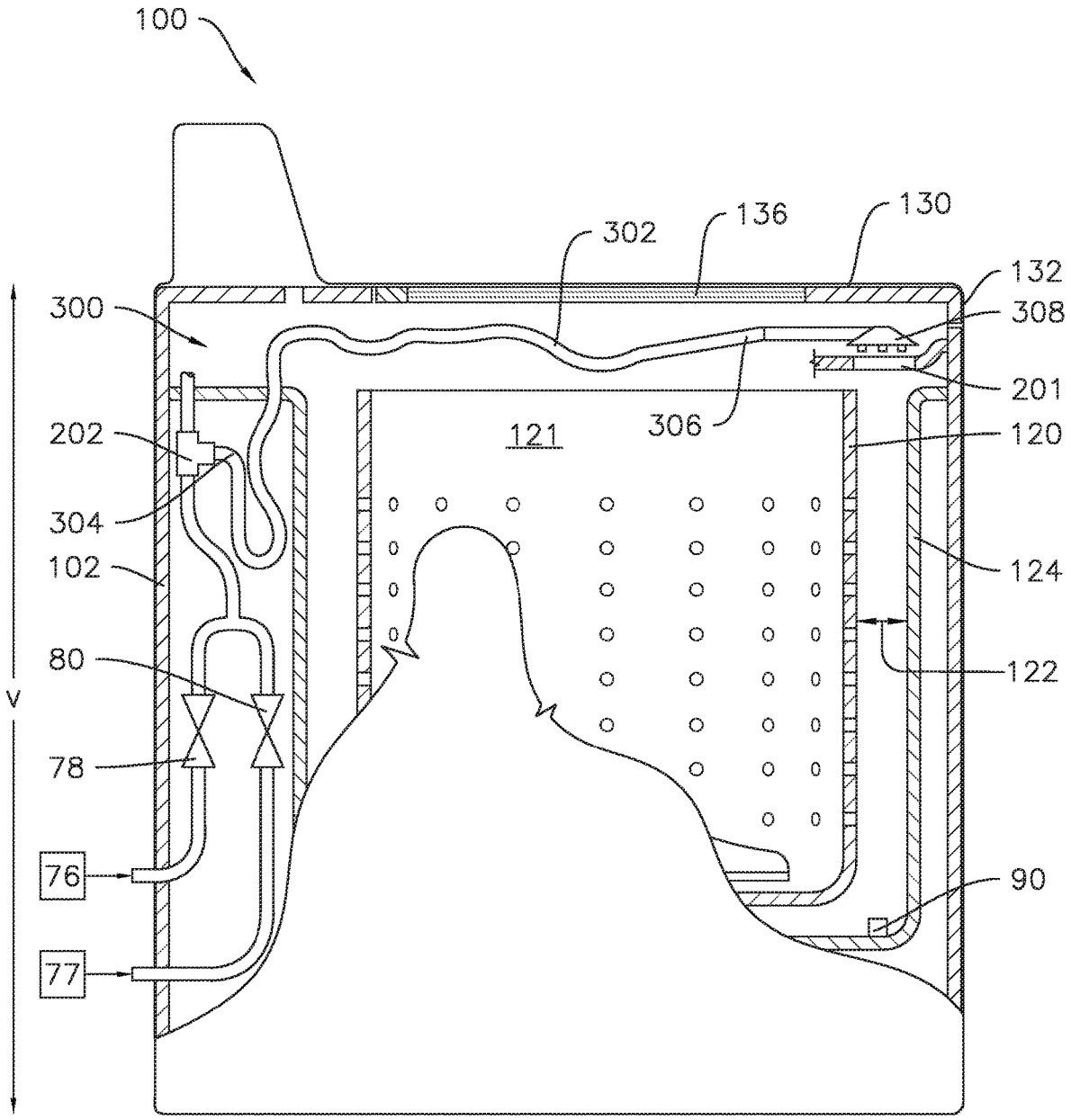
FIG. 3 provides a side cutaway view of the exemplary washing machine appliance of FIG. 1.

Referring still to FIG. 3, each valve 78, 80 may be selectively adjusted between an open position allowing a flow of fluid therethrough and a closed position terminating or obstructing the flow of fluid therethrough. Hot water valve 78 may be in fluid communication with hot water source 76, which may be external to the washing machine appliance 100. Similarly, cold water valve 80 may be in fluid communication with cold water source 77, which may also be external to the washing machine appliance 100. The cold water source 77 may, for example, be a commercial water supply, while the hot water source 76 may be, for example, a water heater appliance.

As illustrated for example in FIG. 3, washing machine appliance 100 further includes a spray hose assembly 300 fluidly connected to one or more of the water sources 76, 77 and configured for selectively providing a flow of wash fluid in a desired direction and location. More particularly, for the embodiment depicted, spray hose assembly 300 is fluidly connected to a three-way valve 202 positioned within cabinet 102. Three-way valve 202 is depicted as a T-valve downstream of valves 78, 80. However, in other exemplary embodiments, any suitable three-way valve 202 may be utilized, and further, three-way valve 202 may be attached in any suitable location. For example, in other embodiments, three-way valve 202 may be a Y-valve, and/or may be upstream of valves 78, 80. In the latter embodiment, washing machine appliance 100 may further include two three-way valves, such that a first three-way valve is upstream of hot water valve 78, and a second three-way valve is upstream of cold water valve 80. By being positioned upstream of valves 78, 80, spray hose assembly 300 may provide a flow of water independently from a flow of water provided to other parts of the washing machine appliance 100 (i.e., independently of whether or not valves 78, 80 are open or closed). Alternatively, a single three-way valve may be provided upstream of either hot water valve 78 or cold water valve 80. Notably, in such an embodiment, a spray hose assembly 300 may only provide hot water or cold water, respectively.

Spray hose assembly 300 includes a hose 302 and a spray head 308. Spray hose assembly 300 is generally configured for providing a flow of wash fluid, e.g., water, into wash tub 124. More specifically, the flow of wash fluid is provided through semi-rigid or flexible hose 302. Flexible hose 302 is generally any fluid conduit that extends from a fluid supply to a location suitable for discharging wash fluid into wash tub 124. In this regard, for example, flexible hose 302 may include an inlet 304 and an outlet 306. Inlet 304 is fluidly connected to a three-way valve 202 for receiving a flow of wash fluid. Although flexible hose 302 is illustrated as being coupled to three-way valve 202, it should be appreciated that flexible hose 302 could instead be connected to a detergent box, a wash additive reservoir, a hot or cold water supply, or any other suitable wash fluid supply source. According to an exemplary embodiment, flexible hose 302 may be constructed from any suitably flexible conduit, such as vinyl or rubber. In addition, as used herein, "wash fluid" may refer to water, detergent, fabric softener, bleach, or any other suitable wash additive or combination thereof. According to the illustrated embodiment, spray head 308 is attached to the outlet 306 of flexible hose 302. Spray head 308 is generally configured for directing the flow of wash fluid in the desired direction, generating the desired spray pattern, or otherwise controlling the flow of wash fluid. For example, as best seen in FIGS. 4 through 9, spray head 308 includes a plurality of outlets 316 through which a wash fluid, e.g., water, may be sprayed for directing the flow of wash fluid to desired locations, e.g., in the tub 124. In various embodiments, outlets 316 may, for example, be tubes extending from the spray head 308, or alternatively may simply be holes or apertures defined in the spray head 308. However, in other embodiments, outlets 316 may be nozzles or any other suitable openings through which wash fluid may be sprayed. Further, spray head 308 may additionally include other openings, holes, etc. (not shown) through which water may be flowed, i.e., sprayed or poured, into the tub 124 and/or basket 120.

As shown in FIGS. 4 through 7, an additive dispenser, or dispenser cup, 210 may additionally be provided for directing a fluid additive, such as detergent, bleach, liquid fabric softener, etc., into tub 120, e.g., at gap 122 as described below. For example, dispenser 210 may be in fluid communication with a spray hose assembly such that water flowing from flexible hose 302 to spray head 308 flows through dispenser 210, mixing with the fluid additive at a desired time during operation to form a liquid or wash fluid, before being flowed into tub 124.

Fluid additive dispenser 210 is mounted above wash tub 124 and wash basket 120 (e.g., along the vertical direction V shown in FIG. 1). More particularly, fluid additive dispenser 210 may be mounted directly below opening 201 and directly above a gap 122 (e.g., along the vertical direction V shown in FIG. 1). Gap 122 is defined between wash tub 124 and wash basket 120 and may correspond to the radial space between wash tub 124 and wash basket 120. Additive dispenser 210 extends between and provides fluid communication between the opening 201 of the top panel 200 and the gap 122. Fluid additive dispenser 210 is configured for receipt of one or more fluid additives from opening 201 (FIG. 2). Fluid additive dispenser 210 is also configured for directing the fluid additive(s) into gap 122. For example, fluid additive dispenser 210 may be in fluid communication with wash tub 124 and wash basket 120 for adding fluids, e.g. fabric softener or bleach, to wash tub 124. In particular, the fluid additive dispenser 210 may be in direct fluid communication with the gap 122 and in fluid communication with the wash tub 124 and wash basket 120 via the gap 122, e.g., fluid may flow from the fluid additive dispenser 210 directly into gap 122 and from the gap 122 into one or both of the wash tub 124 and wash basket 120.

As illustrated in FIGS. 4 through 7, in various embodiments a dock 400 may be provided. The dock 400 is configured to retain the spray head in a docked position, as shown, where the spray head 308 is docked with the opening 201 in the docked position. Consequently, the spray hose assembly 300, and in particular spray head 308 thereof, is in fluid communication with the additive dispenser 210 via the opening 201 when the spray head 308 is in the docked position.

Figure 4:
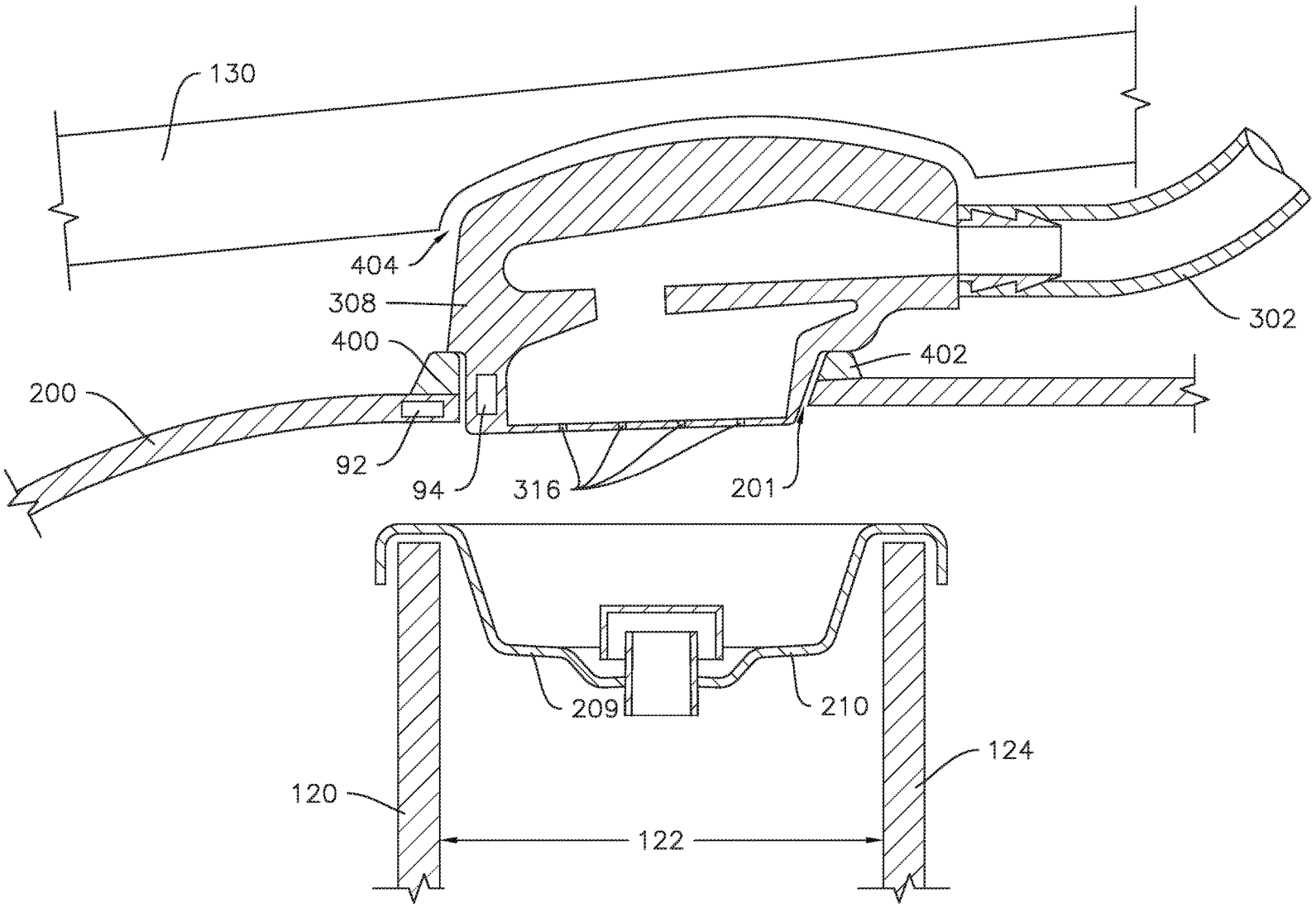
FIG. 4 provides a section view of a portion of the exemplary washing machine appliance of FIG. 1 according to one or more exemplary embodiments of the present subject matter.

As illustrated in FIG. 4, in some embodiments, the dock 400 may include a bezel 402 extending around a perimeter of the opening 201. For example, in embodiments where the opening 201 is rounded, e.g., oval or circular, the bezel 402 may extend partially or completely around the circumference of the opening 201. In additional embodiments, the opening 201 may have any suitable shape such as rectangular, octagonal, or any other polygonal or non-polygonal shape and the bezel 402 may extend partially or completely around a perimeter thereof. Also illustrated in FIG. 4, the lid or door 130 may include a recess 404 formed therein. In such embodiments, the dock 400 may include the recess 404. For example, the recess 404 may be sized to receive the spray head 308 within the recess 404 and the recess 404 may be positioned in the lid 130 at a location corresponding to the opening 201 of the top panel 200 such that the recess 404 overlies the opening 201 when the lid 130 is in the closed position. Accordingly, the recess 404 may receive and retain the spray head 308 such that the spray head 308 is docked with the opening 201.

Figure 5:
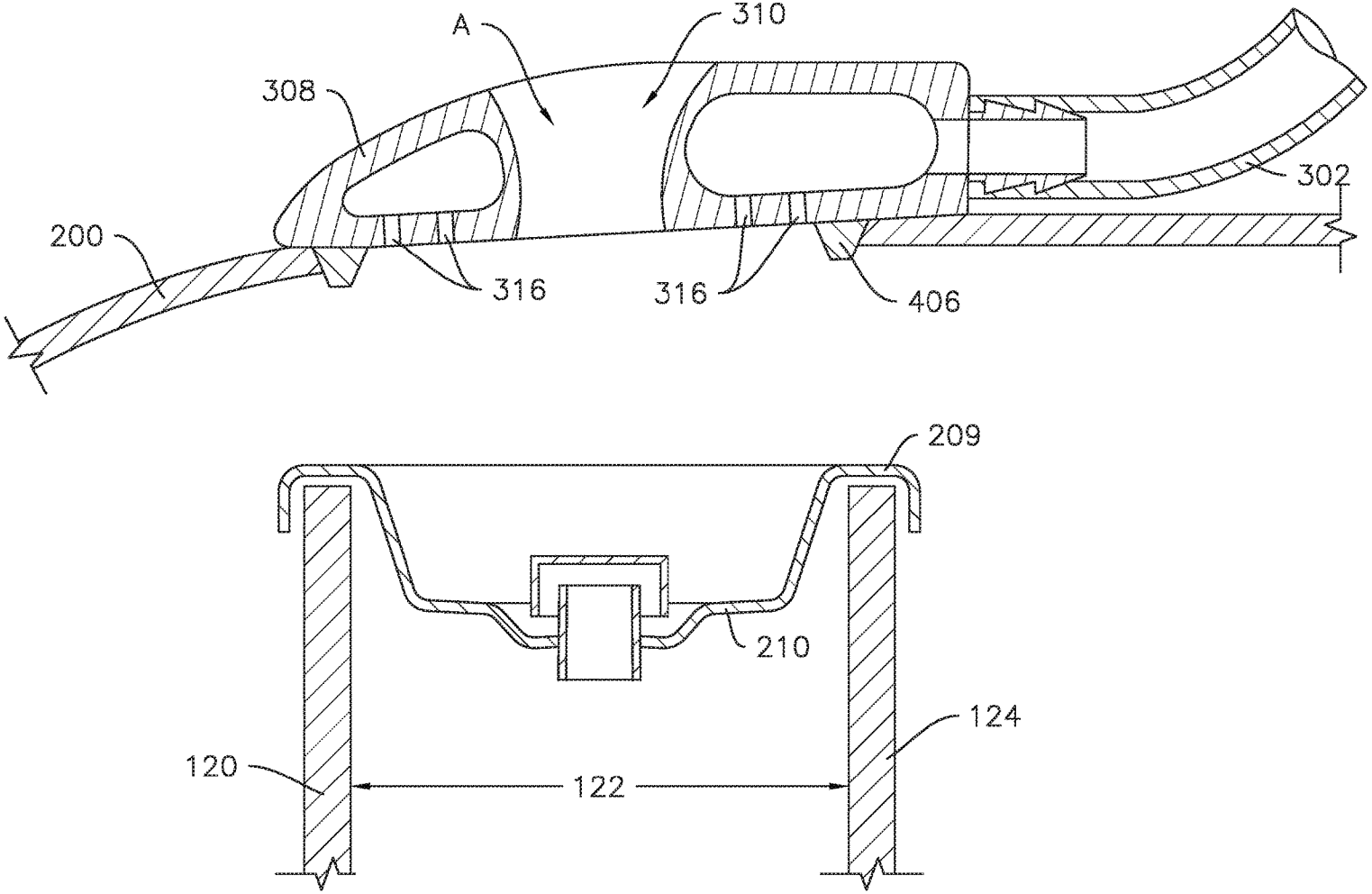
FIG. 5 provides a section view of a portion of the exemplary washing machine appliance of FIG. 1 according to one or more additional exemplary embodiments of the present subject matter.

As illustrated in FIG. 5, in some embodiments, the spray head 308 may include a rib 406. The rib 406 may project from the spray head 308, e.g., generally along the vertical direction V when the spray head 308 is positioned over and aligned for fluid communication with the opening 201. Accordingly, the rib 406 may be sized to fit snugly within the opening 201. In such embodiments, the dock 400 may include the rib 406. In additional embodiments, the rib 406 may be provided in various combinations with the bezel 402 and/or recess 404 described above.

Figure 6:
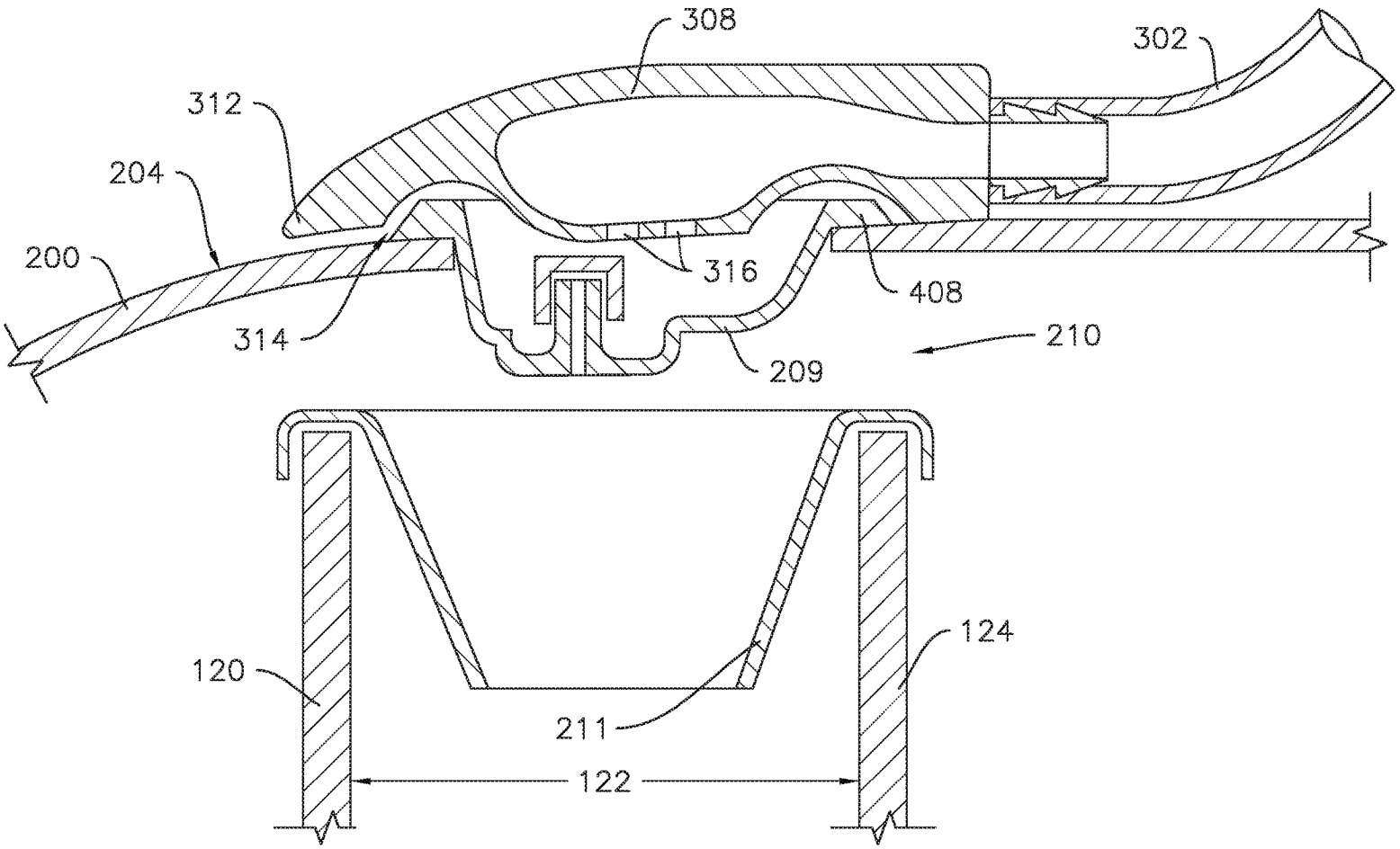
FIG. 6 provides a section view of a portion of the exemplary washing machine appliance of FIG. 1 according to one or more additional exemplary embodiments of the present subject matter.
Figure 7:
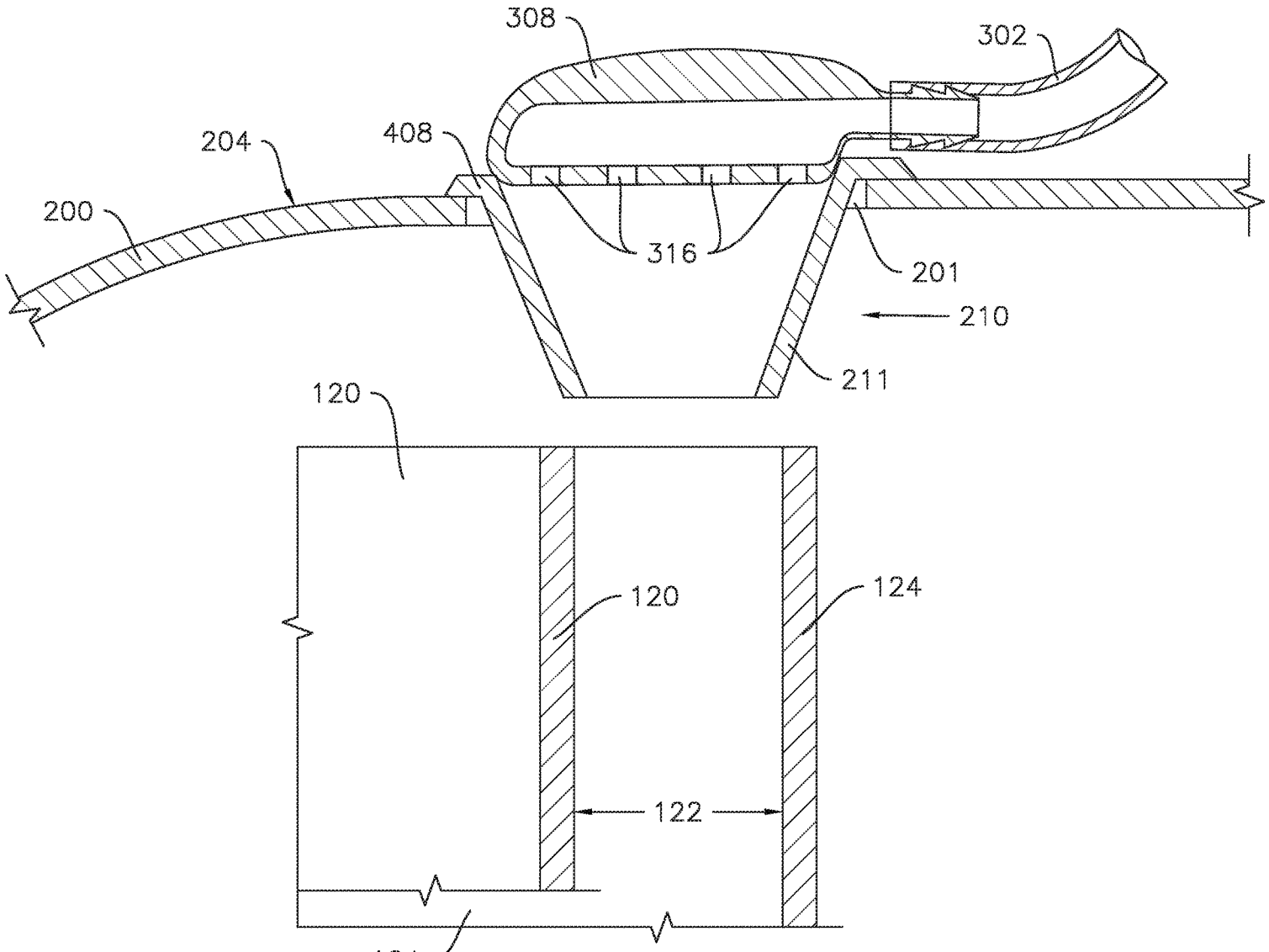
FIG. 7 provides a section view of a portion of the exemplary washing machine appliance of FIG. 1 according to one or more additional exemplary embodiments of the present subject matter.

As illustrated in FIGS. 6 and 7, in some embodiments, the additive dispenser 210 may include a flange 408 formed around an upper perimeter of the additive dispenser 210 and connected to the opening 201. For example, as illustrated, the additive dispenser 210 may be mounted to the top panel 200, and in particular upper surface 204 of the top panel 200 at the opening 201 with the flange 408 contacting the upper surface 204 of the top panel 200 and the remainder of the additive dispenser 210 extending through the opening 201 downward along the vertical direction V from the flange 408 and below the top panel 200. In such embodiments, the dock 400 may include the flange 408 of the additive dispenser 210. In some embodiments, as illustrated in FIG. 6, the additive dispenser 210 may include a siphon cup 209. In additional embodiments, as illustrated in FIG. 7, the additive dispenser 210 may include a funnel 211. In various embodiments, combinations of such features may be provided, e.g., as illustrated in FIG. 6, both a siphon cup 209 and a funnel 211 may be provided. Moreover, the additive dispenser 210 may be provided on or below the top panel 200 in various embodiments. For example, as shown in FIGS. 4 and 5, the additive dispenser 210 may include a siphon cup 209 positioned below the top panel 200. As another example, in some embodiments, the additive dispenser 210 may include siphon cup 209 positioned on the top panel 200, e.g., as illustrated in FIG. 6. Also illustrated in FIG. 6, the additive dispenser 210 may include funnel 211 positioned below the top panel 200. As yet another example, in some embodiments, the additive dispenser 210 may include funnel 211 positioned on the top panel 200, e.g., as illustrated in FIG. 7.

Also illustrated in FIG. 6, the spray head 308 may include a hook 312 and/or a recess 314. In various embodiments, the hook 312 and/or recess 314 of the spray head 308 may be configured to engage with the dock 400. For example, in the embodiment illustrated in FIG. 6, the hook 312 and recess 314 are configured to engage the flange 408. In additional embodiments, the hook 312 and/or recess 314 may be configured to engage the bezel 402 (FIG. 4) as well as or instead of the flange 408.

Figure 8:
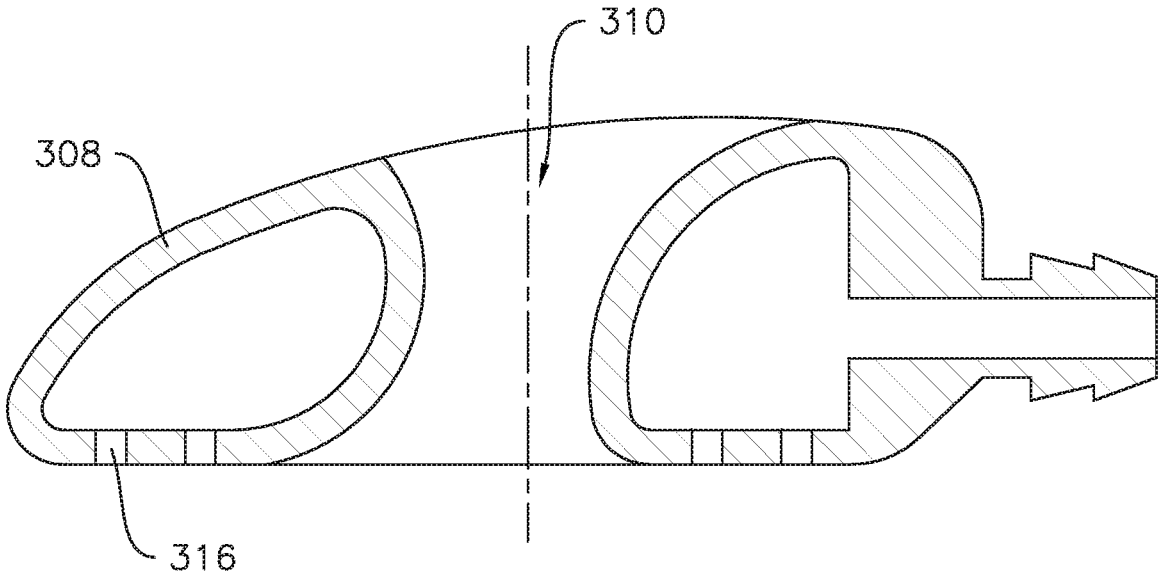
FIG. 8 provides a section view of a spray head of a spray hose assembly according to one or more exemplary embodiments of the present subject matter.
Figure 9:
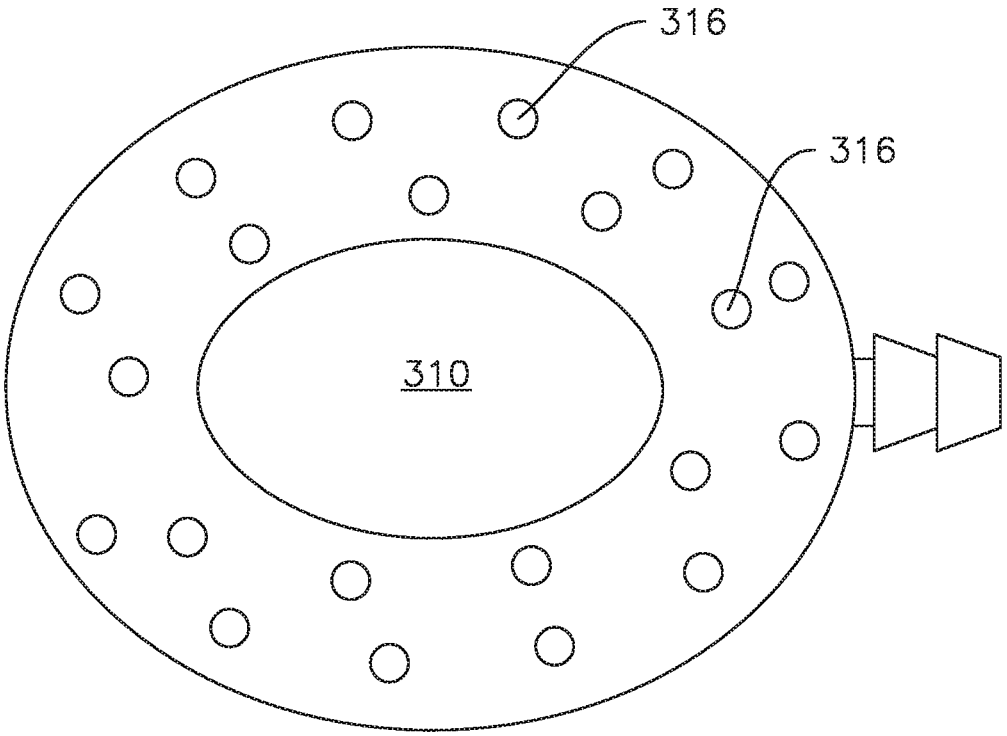
FIG. 9 provides a bottom view of the spray head of FIG. 8.
Figure 10:
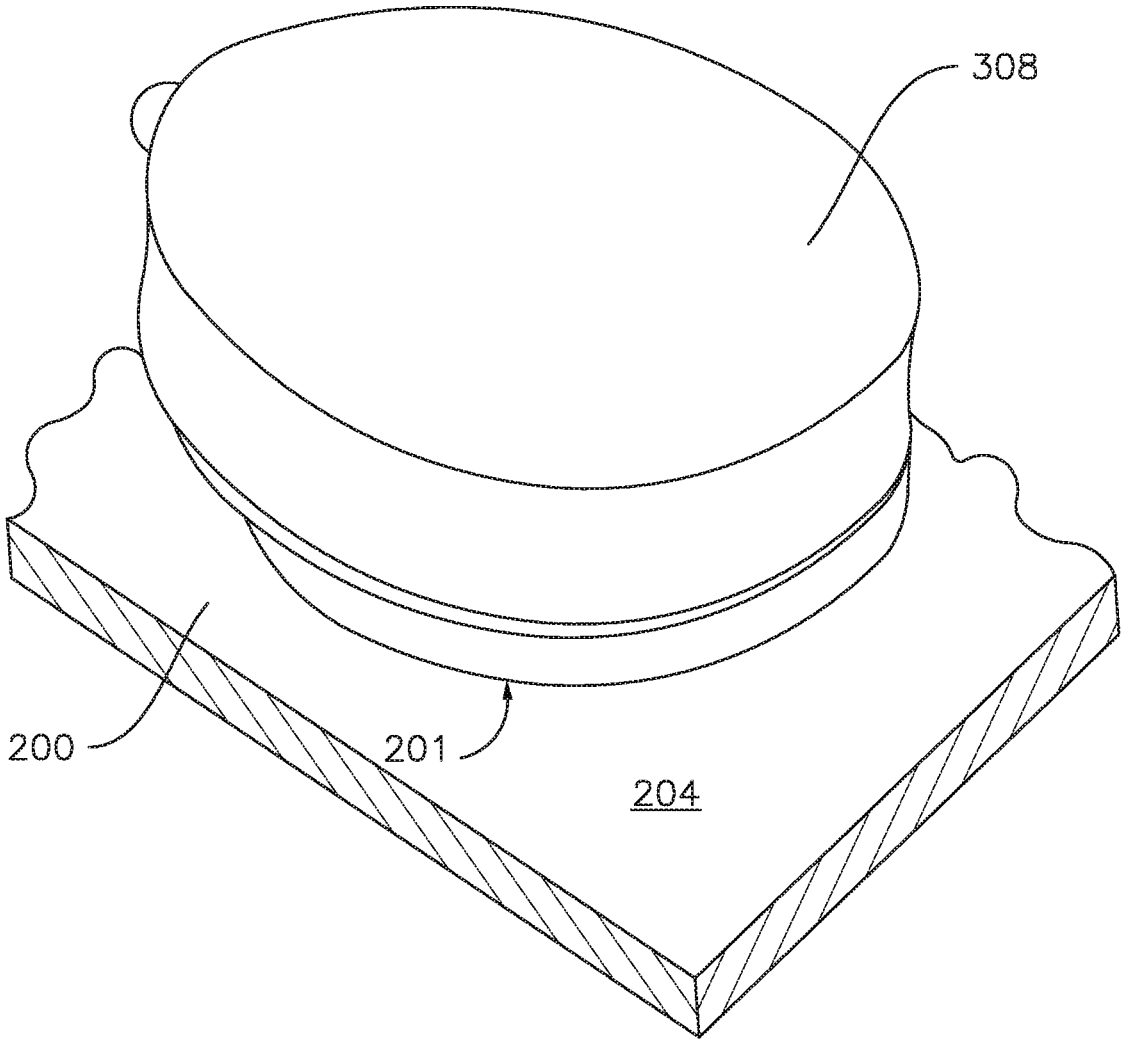
FIG. 10 provides a perspective view of a spray head of a spray hose assembly according to one or more additional exemplary embodiments of the present subject matter.

As best seen in FIGS. 8 and 9, in some embodiments, the spray head 308 comprises a toroidal shape defining a central aperture 310. In such embodiments, additives A (FIG. 5) may be poured into the additive dispenser 210 while the spray head 308 is docked with the opening 201 by pouring the additives A through the central aperture 310 of the spray head 308. In other embodiments, for example as best shown in FIG. 10, the spray head 308 may define a solid shape such that the spray head 308 fully encloses the opening 201 of the top panel 200 when the spray head 308 is in the docked position.

As mentioned above, the washing machine appliance 100 may include various sensors, e.g., pressure sensor 90. Additionally, the washing machine appliance 100 may also include a proximity sensor 92 configured to detect when the spray head 308 is in the docked position. For example, as illustrated in FIG. 4, the proximity sensor may comprise a reed switch 92 and the reed switch 92 may respond to the presence of a magnet 94 in the spray head 308. The proximity sensor 92 may prevent unintended operation of the spray hose assembly 300, e.g., directing wash fluid outside of the washing machine appliance 100. The proximity sensor 92 may also prevent unintended operation of the washing machine appliance 100, such as a spin cycle of the washing machine appliance 100 when the spray head 308 is not docked with the opening 201 of the top panel 200, e.g., if the spray head 308 is in the tub 124 or basket 120, spinning the basket 120 may result in damage to the spray head 308, the tub 120 and/or basket 124. The proximity sensor 92 may be in operative communication with the controller or processing device. In some embodiments, the controller may be configured to provide an alert, such as by activating an audible and/or visual indicator, when the spray head 308 is not docked with the opening 201.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a cabinet defining a vertical direction;
- a wash tub mounted within the cabinet and configured for containing fluid during operation of the washing machine appliance;
- a wash basket rotatably mounted within the wash tub, the wash tub and the wash basket defining a gap between the wash tub and the wash basket;
- a top panel of the cabinet comprising an opening positioned above the gap between the wash tub and the wash basket along the vertical direction;
- an additive dispenser extending between the opening of the top panel and the gap between the wash tub and the wash basket;
- a spray hose assembly fluidly connected to a wash fluid source and configured for selectively providing a flow of wash fluid in a desired direction and location, the spray hose assembly including a hose and a spray head attached to the hose; and
- a dock configured to retain the spray head in a docked position with the opening whereby the spray hose assembly is in fluid communication with the additive dispenser, wherein the spray head fully encloses the opening of the top panel when the spray head is in the docked position.

2. The washing machine appliance of claim 1, wherein the dock comprises a bezel extending around a perimeter of the opening.

3. The washing machine appliance of claim 1, wherein the dock comprises a rib on the spray head.

4. The washing machine appliance of claim 1, further comprising a lid rotatably mounted to the top panel, wherein the dock comprises a recess in the lid.

5. The washing machine appliance of claim 1, wherein the additive dispenser comprises a flange connected to the opening, and the dock comprises the flange of the additive dispenser.

6. The washing machine appliance of claim 1, wherein the spray head comprises a toroidal shape defining a central aperture.

7. The washing machine appliance of claim 1, wherein the additive dispenser comprises a siphon cup positioned on the top panel.

8. The washing machine appliance of claim 1, wherein the additive dispenser comprises a siphon cup positioned below the top panel.

9. The washing machine appliance of claim 1, wherein the additive dispenser comprises a funnel positioned on the top panel.

10. The washing machine appliance of claim 1, wherein the additive dispenser comprises a funnel positioned below the top panel.

11. The washing machine appliance of claim 1, further comprising a proximity sensor configured to detect when the spray head is in the docked position.

12. A washing machine appliance comprising:
- a cabinet defining a vertical direction;
- a wash tub mounted within the cabinet and configured for containing fluid during operation of the washing machine appliance;
- a wash basket rotatably mounted within the wash tub, the wash tub and the wash basket defining a gap between the wash tub and the wash basket;
- a top panel of the cabinet comprising an opening positioned above the gap between the wash tub and the wash basket along the vertical direction;
- an additive dispenser extending between the opening of the top panel and the gap between the wash tub and the wash basket;
- a spray hose assembly fluidly connected to a wash fluid source and configured for selectively providing a flow of wash fluid in a desired direction and location, the spray hose assembly including a hose and a spray head attached to the hose, wherein the spray head comprises a toroidal shape defining a central aperture; and
- a bezel extending around a perimeter of the opening, the bezel configured to retain the spray head in a docked position with the additive dispenser whereby the spray hose assembly is in fluid communication with the additive dispenser.

13. The washing machine appliance of claim 12, further comprising a lid rotatably mounted to the top panel, wherein the lid comprises a recess positioned to overlie the opening in the top panel when the lid is in a closed position, the recess sized to retain the spray head in the docked position.

14. The washing machine appliance of claim 12, wherein the spray head fully encloses the opening of the top panel when the spray head is in the docked position.

15. A washing machine appliance comprising:
- a cabinet defining a vertical direction;
- a wash tub mounted within the cabinet and configured for containing fluid during operation of the washing machine appliance;
- a wash basket rotatably mounted within the wash tub, the wash tub and the wash basket defining a gap between the wash tub and the wash basket;
- a top panel of the cabinet comprising an opening positioned above the gap between the wash tub and the wash basket along the vertical direction;

an additive dispenser extending between the opening of the top panel and the gap between the wash tub and the wash basket;

a spray hose assembly fluidly connected to a wash fluid source and configured for selectively providing a flow of wash fluid in a desired direction and location, the spray hose assembly including a hose and a spray head attached to the hose, the spray head comprising a rib, the rib configured to retain the spray head in a docked position with the opening whereby the spray hose assembly is in fluid communication with the additive dispenser; and a lid rotatably mounted to the top panel, wherein the lid comprises a recess positioned to overlie the opening in the top panel when the lid is in a closed position, the recess sized to retain the spray head in the docked position.

16. The washing machine appliance of claim 15, wherein the spray head comprises a toroidal shape defining a central aperture.

17. The washing machine appliance of claim 15, wherein the spray head fully encloses the opening of the top panel when the spray head is in the docked position.

* * * * *